US005080285A

United States Patent [19]

Toth

[11] Patent Number: 5,080,285

[45] Date of Patent: Jan. 14, 1992

[54] AUTOMATIC PAINT SPRAY GUN

[76] Inventor: Denis W. Toth, 5060 Cooley Lake Rd., Pontiac, Mich. 48084

[21] Appl. No.: 448,728

[22] Filed: Dec. 11, 1989

Related U.S. Application Data

[63] Continuation-in-part of Ser. No. 220,497, Jul. 11, 1988, abandoned.

[51] Int. Cl.[5] ..... B05B 7/08

[52] U.S. Cl. ..... 239/300; 239/424

[58] Field of Search ..... 239/290, 296, 300, 129, 239/DIG. 14, 418, 423, 424

[56] References Cited

U.S. PATENT DOCUMENTS

| | | | |
|---|---|---|---|
| 2,708,094 | 5/1955 | Mitchel | 239/300 X |
| 2,860,918 | 11/1958 | White et al. | 239/129 |
| 3,013,730 | 12/1961 | Bok et al. | 239/137 X |
| 4,190,205 | 2/1980 | Mitchell | 239/129 |
| 4,842,162 | 6/1989 | Merkel | 239/583 X |

FOREIGN PATENT DOCUMENTS

| | | | |
|---|---|---|---|
| WO81/01670 | 6/1981 | PCT Int'l Appl. | 239/DIG. 14 |

*Primary Examiner*—Andres Kashnikow
*Assistant Examiner*—Kevin P. Weldon
*Attorney, Agent, or Firm*—Weintraub, DuRoss & Brady

[57] ABSTRACT

The automatic paint spray gun is for industrial applications involving use with industrial robots. The spray gun comprises a housing including a tubular extension; an air cap mountable onto the tubular extension of the housing; a nozzle disposed within the air cap; and a device for adjusting the flow of air through the housing independent of the air cap. The paint is supplied under pressure to a paint discharge orifice in the nozzle through a first passage. The first passages is essentially centrally disposed within the tubular extension. The atomizing air is supplied to the paint discharge orifice through a second passage to control the atomizing of the paint spray gun. The atomizing air is supplied to the nozzle through a second passage. The second passage is supplied through an annular chamber in the tubular extension, the annual chamber being disposed radially outwardly from the first passage. The fanning air is supplied to the fan discharge openings through a plurality of passages in the tubular extension, the fanning are controlling the fanning of the paint spray. The fanning air is supplied through the plurality of passages disposed radially outwardly from the annular chamber. In addition, the fanning of the paint spray may be regulated independently of the rotative position of the air cap with either turbine air or compressed air.

7 Claims, 4 Drawing Sheets

AUTOMATIC PAINT SPRAY GUN

CROSS-REFERENCE TO RELATED APPLICATIONS

This is a continuation-in-part of copending U.S. patent application Ser. No. 07/220,497 filed on July 11th, 1988, now abandoned entitled "Fan Adjustment for Paint Spray Gun", by Denis W. Toth, the disclosure of which is hereby incorporated by reference.

BACKGROUND OF THE INVENTION

In conventional paint spray guns, a stream of paint under pressure is discharged from a relatively small orifice in a nozzle while air under pressure is discharged radially inwardly into the stream from an annular opening surrounding the nozzle closely adjacent the paint discharge orifice to atomize the stream of paint into a spray of fine particles. The spray produced moves away from the gun in an expanding conical pattern whose apex is at the nozzle.

It is frequently desired to modify the circular cross-section of the normal conical spray pattern by transforming this pattern into one of a narrowed and elongated generally elliptically shaped cross-section so that the spray pattern more closely resembles that of a flat sided fan.

Conventionally, fanning of the spray pattern is accomplished by providing a pair of diametrically opposed ports on the front of the air cap spaced radially outwardly from opposite sides of the annular air discharge opening. The diametrically opposed ports are oriented to direct air jets toward opposite sides of the spray pattern at a location spaced a short distance forwardly from the nozzle orifice. These jets have the effect of flattening the sides of the conical spray pattern against which they are directed. At any given distance from the nozzle, this action transforms the normally circular cross-section of the conical spray into a generally elliptically shaped cross-section. The major axis of the conical spray is somewhat greater than the original cone diameter, and the minor axis of the conical spray is somewhat less than the original cone diameter. The elliptical cross-section becomes more flat with an increase of the air pressure from the diametrically opposed fanning ports.

Conventionally, adjustment of the fanning of the paint spray is accomplished by either rotatably adjusting the air cap (turbine powered low pressure guns) or through an adjustment valve (high pressure guns). A valve stem is adjusted by a thumb screw to restrict the flow of compressed air into a second passage connected to the fanning ports on the air cap. Conventional automatic guns have a separate air supply that can adjust the flow independent of the thumb screw. This adjustment exerts a valving action which establishes maximum air flow when the diametrically opposed valve ports lie in either a vertical plane containing the nozzle axis or a horizontal plane containing the nozzle axis. The flow through the fanning air ports is reduced as the air cap is rotated, and the fanning air flow is cut off when the fanning air ports are midway between the horizontal and vertical positions referred to above. When the fanning air ports are at this midway position, the paint spray assumes its original conical form.

While the foregoing arrangement provides for adjustment of the fanning air to the paint spray, this adjustment is dependent upon the rotated position of the air cap about the nozzle axis. Adjustment of the fan width (minor axis of the elliptical fan cross-section) to a width between maximum or unmodified conical spray and minimum width requires the ports of the air cap to be disposed in a general plane inclined from the vertical. This inclination of the fanning air ports establishes the angle that the major axis of the elliptical configuration will assume with respect to the vertical, a situation which is inconvenient to the operator who would prefer that this major axis be either vertical or horizontal for all degrees of fanning.

The present invention is directed to a spray gun in which fanning may be adjustably controlled independently of the rotative orientation of the air cap and which operates on air being supplied to the paint spray gun at low pressures and high volumes.

SUMMARY OF THE INVENTION

The low pressure/high volume system of the present invention involves the use of turbine air for atomizing air in the first embodiment, and turbine air for fanning air and atomizing air in the second embodiment. As used herein, turbine air is supplied at less than 10 PSI, whereas compressed air is conventionally supplied at pressures of from 5 to 50 PSI. Also, the turbine air is supplied to the paint spray gun at up to 20 CFM, whereas compressed air is supplied at flow rates up to 10 CFM. Turbine air is supplied to the paint spray gun at temperatures higher than ambient temperature (5°-160° F.).

Another advantage of air supplied at lower pressures (turbine air) is that the atomizing air supplied to the paint spray is not as turbulent as high pressure compressed air resulting in an improved transfer efficiency of paint as hereinafter described.

The low pressure/high volume concept results in the improved transfer efficiency of the paint spray gun of the subject invention. Transfer efficiency is defined as the ratio of the paint deposited on the product as compared with the paint used. The transfer efficiency of the paint spray gun of the subject invention is in the range of 65 to 90%.

The automatic spray gun of the present invention is for industrial applications involving use with industrial robots. The spray gun comprises a housing including a tubular extension; an air cap mountable onto the tubular extension of the housing; a nozzle disposed within the air cap; and preferably means for adjusting the flow of air through the housing independent of the air cap.

The paint is supplied under pressure to a paint discharge opening in the nozzle through a first passage. The nozzle has a paint discharge orifice for discharging paint under pressure in a direct stream. The first passage is essentially centrally disposed within the tubular extension.

The atomizing air is supplied to the fan discharge opening through a second passage to control the atomizing of the paint spray. The atomizing air is supplied to the paint spray gun at a temperature higher than ambient temperature and at a pressure of less than 10 psig. The temperature of the atomizing air delivered to the discharge orifice is higher than the temperature of the atomizing air being supplied to the paint spray gun. The atomizing air is supplied to the nozzle through a second passage. The second passage is supplied through an annular chamber in the tubular extension, the annular chamber being disposed radially outwardly from the first passage.

The fanning air is supplied to the fan discharge openings through a plurality of passages in the tubular extension, the fanning air controlling the fanning of the paint spray. The fanning air is preferably supplied to the paint spray gun from a different source than the atomizing air. The fanning air is supplied through the plurality of passages disposed radially outwardly from the annular chamber. The velocity of the fanning air increases as it passes through the plurality of passages.

For a more complete understanding of the storage system and method of the present invention, reference is made to the following detailed description and accompanying drawings in which the presently preferred embodiment of the invention is illustrated by way of example. As the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

DESCRIPTION OF THE PREFERRED EMBODIMENTS

Figures 1, 2:
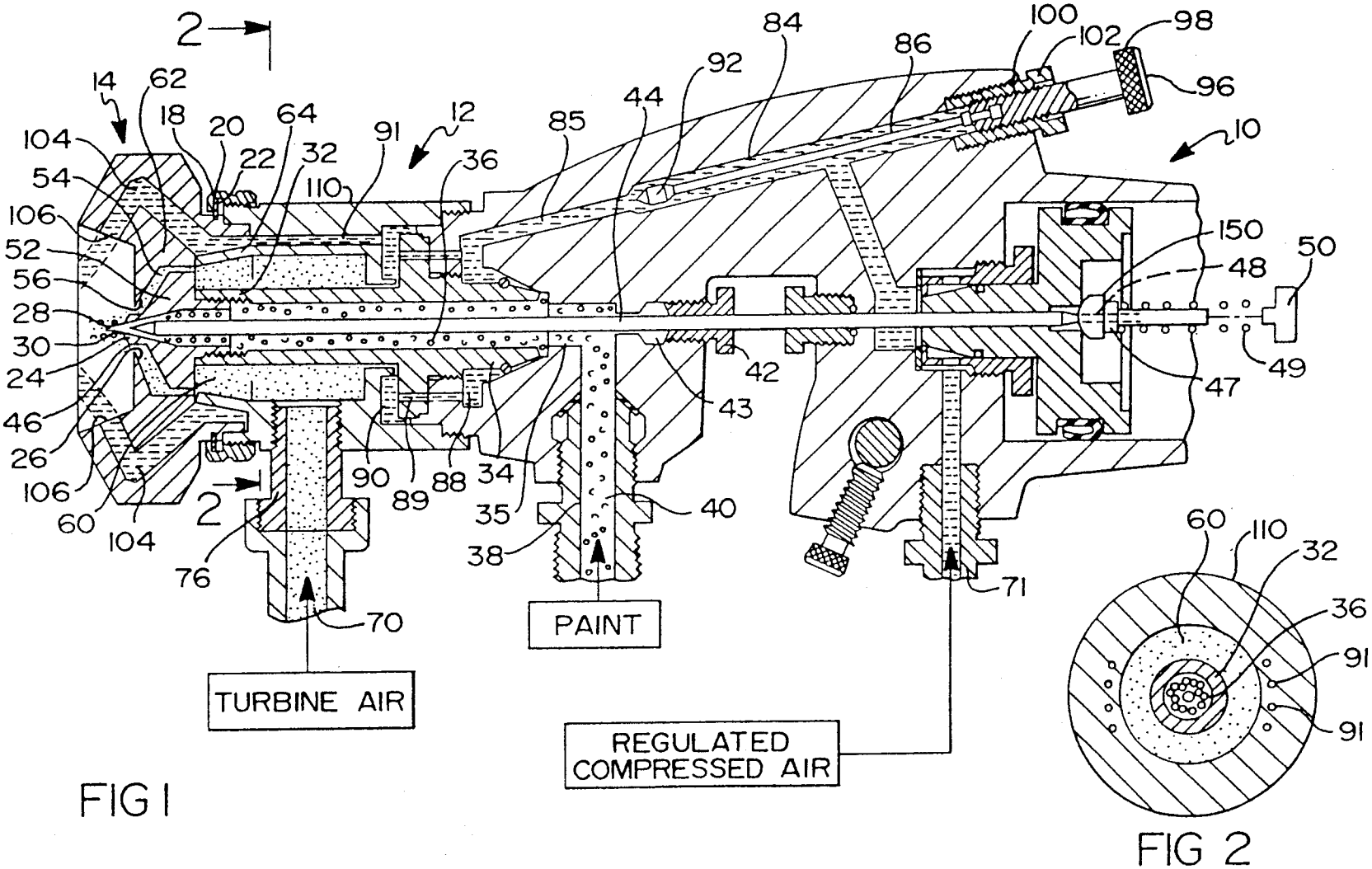
FIG. 1 is a cross-sectional side view of a first embodiment of a paint spray gun embodying the present invention.
FIG. 2 is a detailed cross-sectional view taken on a central vertical plane through the forward portion of the gun of FIG. 1 along the line 2—2 thereof.
Figure 3:
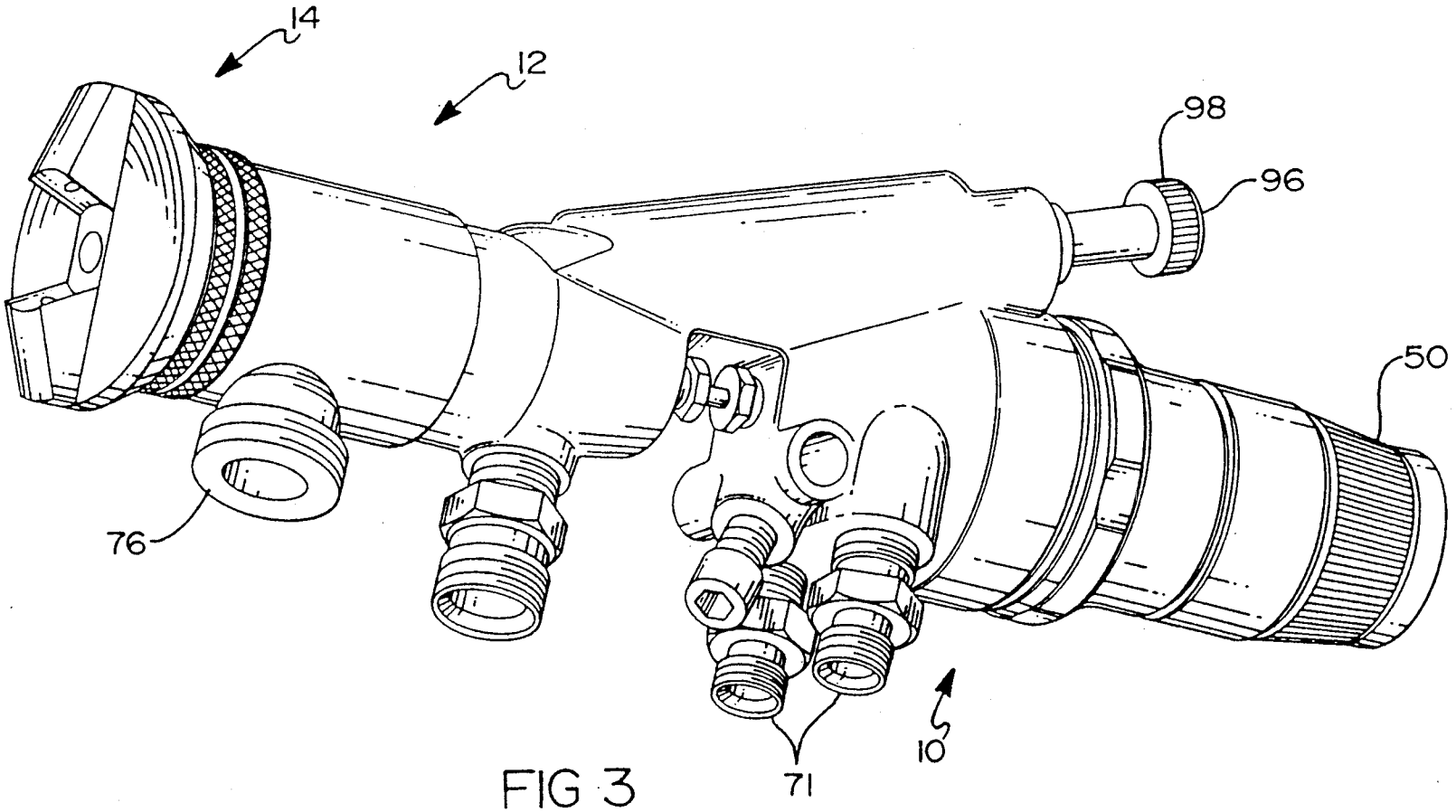
FIG. 3 is a perspective view of the paint spray gun hereof.

Referring first to FIGS. 1 through 4, a spray gun embodying the present invention includes a main housing designated generally at 10 having a forward end and a rearward end, and having a generally cylindrical or tubular extension 12, having a forward end and a rearward end, the rearward end fixedly secured to the forward end of the housing 10. An air cap 14 having a forward end and a rearward end, where the rearward end is fixedly mounted on the front end of extension 12 as by an internally threaded annular ring 16 formed at its forward end with a radially inwardly projection flange 18 axially confined to the main body of the cap as by a C-ring 20 resiliently seated within a circumferential notch 22. The ring 16 is freely rotatable relative to the main body of air cap 14. A nozzle 24 projects coaxially through a central opening 26 in the forward end of air cap 14.

The nozzle 24 is of conventional construction and, as best seen in FIG. 1, is formed with forwardly convergent tapered bore 28 which terminates at an orifice 30 at the front end of the nozzle. The nozzle 24 includes a threaded shank 32 which is threadably received within the forward end of a forwardly projecting hollow tubular member 34 integrally formed on the (tubular) extension 12, and the tubular extension 12 communicates with a bore 35 formed in the main housing 10 through a central passage 36. Paint under pressure is supplied to the central passage 36 which extends through the tubular member 34 via a first fitting or fitting 38 threadably received within housing 10 and having a passage 40 in communication with central passage 36. The rear or right hand end of the passage 36 as viewed in FIG. 1, is closed by a packing 43. Threaded plug 42 slidably supports and guides an elongate rod-like needle valve 44 having a tapered forward end 46 which may be seated in the conical bore 28 of nozzle 24 to close the orifice 30.

Figure 4:
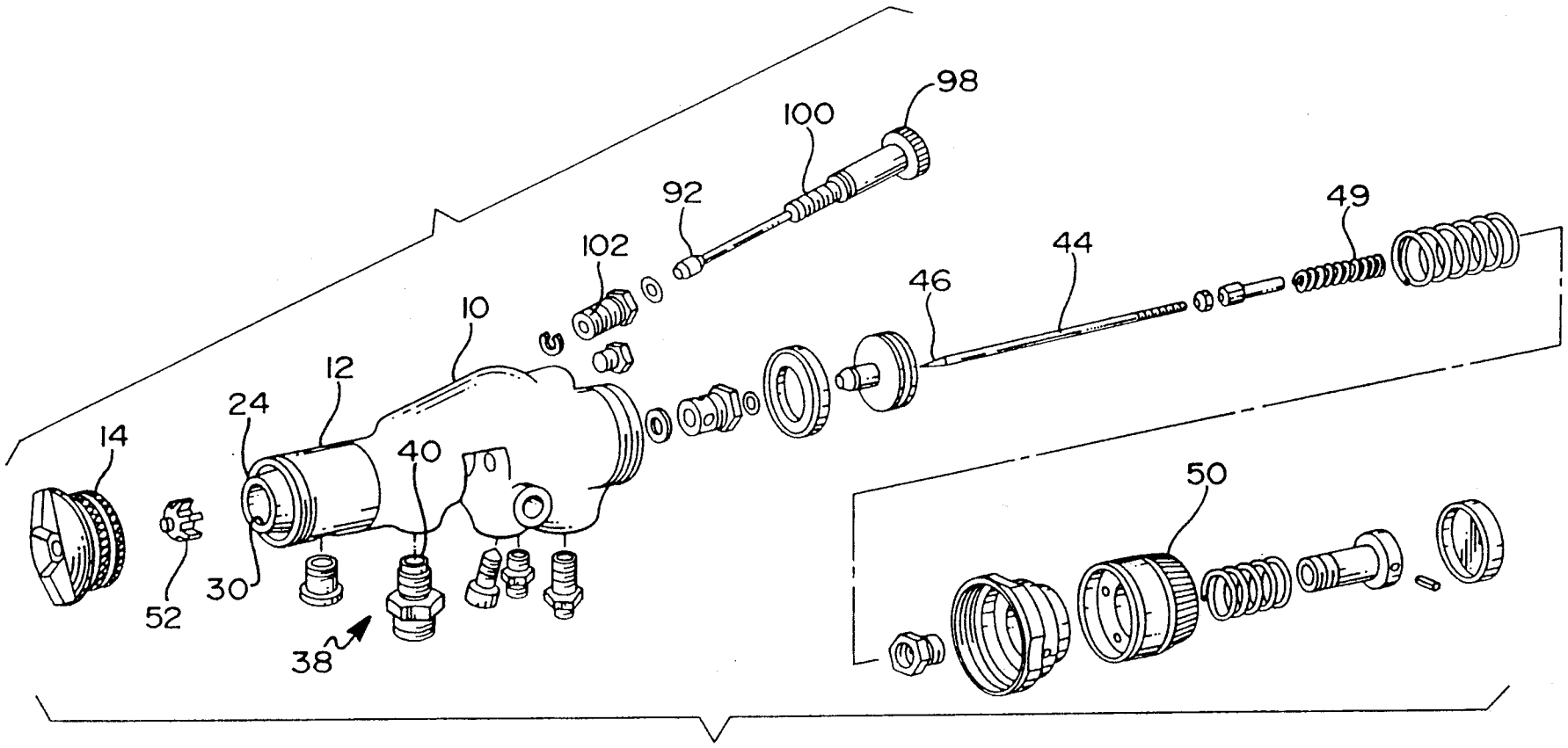
FIG. 4 is an exploded assembly view of the paint spray gun as shown in FIG. 3.

As shown in FIGS. 1 and 4, a piston 150 is axially mounted within the housing 10 to engage an enlarged diameter portion of an adjustable locknut 48 threaded on a needle valve 44 to draw the valve to the right as viewed in FIG. 1 when air pressure is applied in a conventional manner. The needle valve 44 extends rearwardly past the piston 150 and continues through the housing 10 to be coupled to an adjustment knob 50 mounted within the housing.

A spring loaded coupling 47 is disposed between the needle valve 44 and the adjusting knob 50, such as spring 49, of conventional construction which acts to continuously bias needle valve 44 in a forward manner to its closed seated position within the nozzle 24. The adjustment knob 50 essentially locates the end limit of the movement of the needle valve 44 in a rearward manner to establish a maximum opening of the nozzle 24 when the piston 150 is fully moved rearwardly via the compressed air source, against the force of spring 49.

The nozzle 24 is formed with a plurality of radially projecting wings 52 having radially outer ends lying on a cylindrical surface coaxial with the axis of the nozzle 24. The rearward side of an air cap 14 is formed with a counter bore 54 of a diameter such that the outer ends of the wings 52 of the nozzle are slidably received within the counter bore 54. The inner end of the counter bore 54 merges with an inclined conical bore 56, which extends from the counter bore 54 to pierce the front side of the air cap 14, thereby establishing a discharge opening 26 surrounding the forward tip of the nozzle 24. The inclination of the wall of the conical bore 56 and the inclination of the forward side of the nozzle 24 (see the outer ends of the wings 52) and the axial dimensions of the air cap 14 and the nozzle 24 define an air passage. The nozzle 24 and the air cap 14 are assembled in the gun between a discharge opening 26 and a chamber 60 having an enlarged diameter counter bore at the rearward side of the air cap 14. The air passage extends from the discharge opening 26 through space between the opposed incline of the conical bore 56 of the air cap 14 and into the nozzle 24, and thereafter through the spaces between adjacent wings 52 of the nozzle 24. This construction is more particularly described in U.S. Pat. No. 4,744,518, issued May 17, 1988, the disclosure of which is hereby incorporated by reference.

The tubular housing extension 12 is formed with a wall 64 in its forward end of the same diameter as the mating member 62 in the air cap 14, and the wall 64 and the mating member 62 define the turbine air chamber 60. The turbine air chamber 60 is of a diameter larger than the outer diameter of bores 54 and 56 and is in communication therewith such that air passes through the chamber 60, into the bores and exits via the air cap 14 through an orifice 30. Turbine air under pressure may be supplied to the chamber 60 via a second fitting or fitting 76 threaded into the extension 12 and having an air supply passage 70.

As shown in FIG. 1, the upper side of the housing 10, has a bore 84 which is formed to receive the end of an adjustment rod 86.

The bore 84 registers with a bore 88 formed in the main housing 10 and communicates with bores 89 and 90 formed in the tubular extension 12 to define a compressed air passageway 85 through the fanning ports, as shown.

Rod 86 is formed with an enlarged diameter end section 92 at its forward end which passes rearwardly through a slot to an adjustment screw 96. A knurled knob 98 threadably received on the end of actuating rod 86 axially fixes the rod 86 to the adjustment screw 96 while accommodating rotary movement of the screw 96 relative to the rod 86.

The adjustment screw 96 is threadably received as at 100 within a fitting 102 threadably locked to the housing 10. Threading of the adjustment screw 96 into or out of the fitting 102 is transmitted by the actuating rod 86 and acts to adjust air flow for controlling fan control passages.

The rod 86 acts to regulate the flow of compressed air which is used to control the fanning of the paint.

Returning now to FIG. 1, a pair of fan control passages 104 are formed through the air cap 14 to extend from the tubular extension bore 90 in the air cap to inwardly inclined air discharge ports 106.

As shown in FIGS. 1 and 2, air passageway 85 receives air under pressure flowing thereinto from the third fitting or fitting 71, to shape the stream of paint into a flat form. Likewise, air under pressure, preferably, as compressed air, also, freely passes through the passages 104 to be discharged from ports 106 against opposite sides of the conical spray of paint issuing from the nozzle 24.

In order to increase the velocity of the compressed air through the passage 104, a plurality of air passages 91 (for purposes of fanning the paint spray) are formed within the tubular extension 12. The tubular extension 12 has a central opening 36 through which the needle valve 44 projects and which permits paint to pass therethrough. A larger concentric opening or passageway 60 permits air to pass therethrough to be used to atomize the paint spray.

The tubular extension 12 of internal annular ring 110 further is provided with a plurality of fan passages 91. These fan passages increase the velocity of compressed air passing therethrough and enable the air subsequently to expand and contract in passages 104; and yet the air is still at a slower velocity than when it first enters passageway 90.

By the configuration of the passageway 90 compressed air entering through fitting 71 at, for example, 35 psi, issues through port 106 at about 8 psi.

It is to be appreciated that the preferred embodiment of the paint spray gun of the present invention utilizes both compressed air for fanning, and turbine air for atomizing, to provide a low pressure, high volume system.

Figures 5, 6:
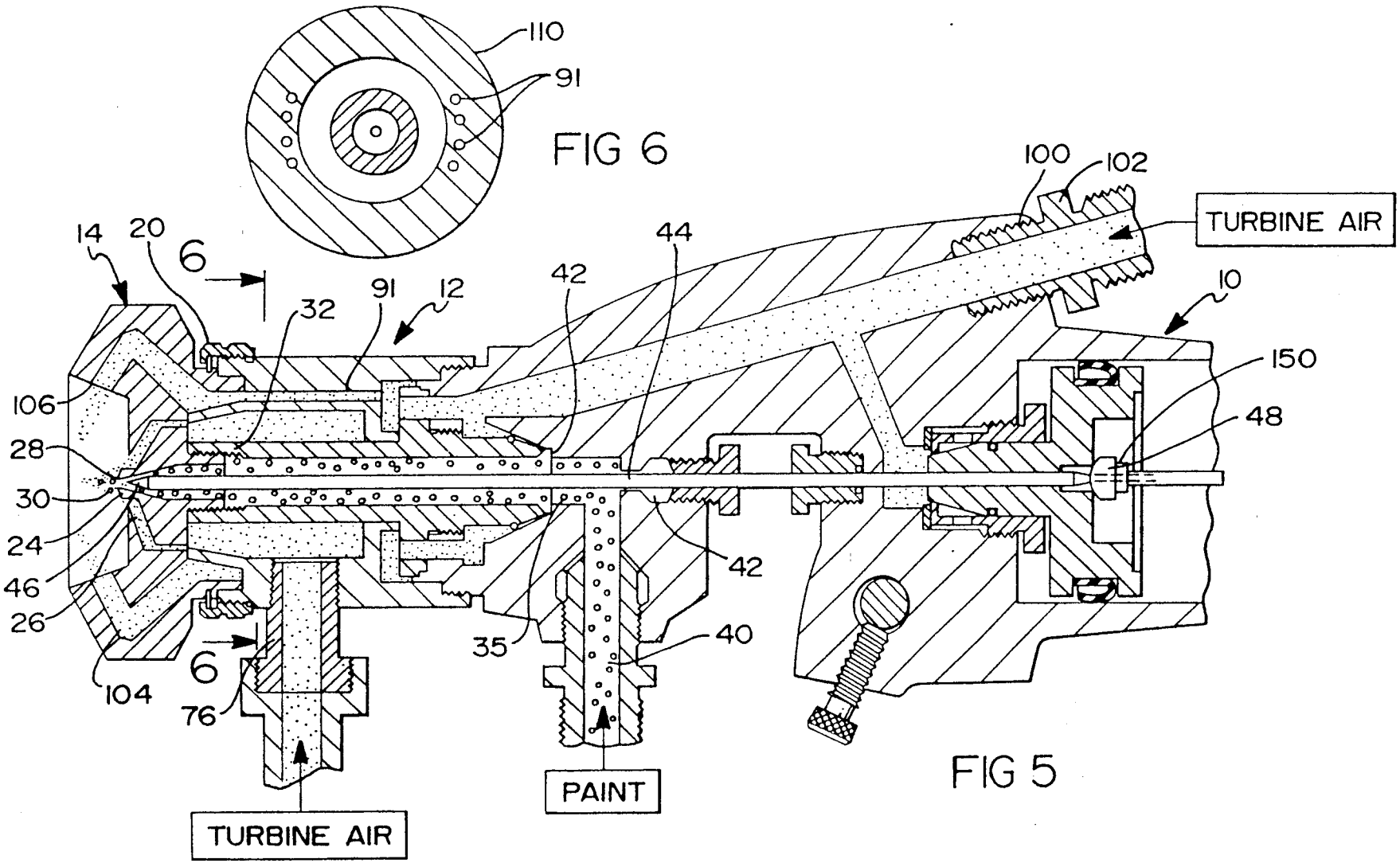
FIG. 5 is a cross-sectional view of a second embodiment hereof.
FIG. 6 is a cross-sectional view of the second embodiment hereof taken along line 5—5 of FIG. 5.

Referring now to FIGS. 5 and 6, there is depicted therein another embodiment hereof. In this embodiment, the construction of the tubular extension 12 and the air cap 14 is the same as in the preferred embodiment. Likewise, paint and turbine air are admixed in the nozzle 24 and delivered. However, in accordance with this embodiment, turbine air is employed both to control atomizing and fanning. The turbine air is heated to a high volume and a low pressure and delivered from a remote source (not shown) into the passageway 91. In this embodiment, no adjustment rod is used to control the amount of turbine air delivered through the port 106 after passing through the passageways 91 of the tubular extension 12. Rather, only a turbine at high volume and low pressure is employed, which is regulated by a simple ball valve (not shown).

By employing all turbine air in this embodiment, there is still further provided a low pressure, high volume paint spray gun. For example, the turbine air at about 7 psig entering passage 91 will exit port 106 at about 6 psi, but at a volume of about 5–6 cfm.

It should be noted that the axial movement of the piston is accomplished with compressed air, as in the first embodiment. However, it is solely turbine air which controls the fanning and delivery of the paint. The construction hereof enables a paint spray gun to operate efficiently between about ¼ psi and up to about 10 psi.

EXAMPLE 1

Operating Parameters

This is a typical example of the operating parameters for the automatic paint spray gun of the present invention, wherein compressor air is used for fanning and turbine air is used for atomizing.

| Atomizing Air Supply | Turbine Air |
|---|---|
| Pressure Range | 1–10 PSI |
| Flow Rate | 2–20 CFM |
| Temperature Range | Ambient + 5° F. to 160° F. Maximum |
| Discharge Orifice | 5 mm to 8 mm |
| Hose Size | ⅜–¾ Inch I.D. |
| Hose Length Range | 4 to 60 Feet |
| Control Means | High Flow Ball Valve |
| **Fanning Air Supply** | **Compressed Air (Piston, Screw, Vane Type)** |
| Pressure Range | 5–50 PSI |
| Flow Rate | 1–10 CFM |
| Temperature | Ambient |
| Discharge Orifices | 2 mm to 5 mm |
| Hose Size | ¼–⅜ Inch I.D. |
| Hose Length | 4–100 Feet |

The line pressure is controlled by a regulator disposed between the compressed air source. The discharge volume is adjusted by either line pressure or a thumb screw valve in gun. Fan air is triggered off and on with the paint fluid.

EXAMPLE 2

Operating Parameters

This is typical of operating parameters for the automatic paint spray gun of the present invention, wherein the turbine air is used for both atomizing and fanning.

| | Turbine Air |
|---|---|
| Atomizing Air Supply | |
| Pressure Range | 1–10 PSI |
| Flow Rate | 2–20 CPM |
| Temperature Range | Ambient 5° F. to 160° F. Maximum |
| Discharge Orifice | 5 mm to 8 mm |
| Hose Size | ⅜–¾ inch I.D. |

-continued

| | Turbine Air |
|---|---|
| Hose Length Range | 4 to 60 Feet |
| Control Means | High Flow Ball Valve |
| Fan Air Supply | |
| Pressure Range | 1-10 PSI |
| Flow Rate | 1-10 CFM |
| Temperature | Ambient + 5° to 160° F. Maximum |
| Discharge Orifices | 2 mm to 5 mm |
| Hose Size | ⅜-½ inch I.D. |
| Hose Length | 4 to 60 feet |
| Control Means | High Flow Ball Valve |

Atomizing air and fanning air are flowing at all times independent of fluid discharge. Additional solendid valves can be placed upstream from the pressure control ball valve to prevent the constant air bleeding if required. These must be opened just prior to triggering the fluid flow from the nozzle to inside adequate atomization of paint at the beginning of discharge from the nozzle orifice.

While the paint spray gun of the present invention has been described in conjunction with specific embodiments, it is evident that many alternatives, modifications, and variations will be apparent to those skilled in the art in light of the disclosure herein. It is intended that the metes and bounds of the invention be determined by the appended claims, rather than by the language of the above specification, and that all such alternatives, modifications, and variations which form a functional or conjointly cooperative equivalent are intended to be included within the spirit and scope of these claims.

I claim:

1. A paint spray gun for delivering a high volume output at a low air cap pressure, the gun comprising:

(a) a housing, the housing having a forward end and a rearward end, the housing further having an air passageway and a central passage formed therein, the housing comprising:

(1) a first fitting for delivering paint into a first bore formed in the housing from the first fitting, the first bore being in fluid communication with the first fitting, the central passage of the housing being in fluid communication with the first bore, such that paint flows into the housing from the first fitting through the first bore and into the central passage;

(2) a second fitting, the second fitting receiving therein air under pressure, at least one air delivery bore formed in the housing fluidly communicating with the second fitting, the at least one air delivery bore being in fluid communication with the air passageway, such that an air under pressure flows into the housing from the second fitting through the at least one air delivery bore and into the air passageway;

(3) an adjustment knob disposed on the rearward end of the housing, a needle valve seated in the adjustment knob, the valve continuing forwardly from the knob into the central passage;

(b) a tubular extension, the extension having a forward end and a rearward end, the needle valve continuing forwardly into the extension, the rearward end of the extension being mounted on the forward end of the housing, the extension having a central opening formed therein, the central opening being in fluid communication with the central passage of the housing thereby allowing the paint to flow into the extension, the extension having a chamber formed therein circumferentially around the central opening and separate therefrom, the extension having:

(1) a third fitting, the third fitting allowing turbine air to enter into the extension, the turbine air being supplied at a pressure of less than 10 psi, the third fitting being in fluid communication with the chamber, the turbine air flowing from the third fitting into the chamber; and (2) a nozzle, the nozzle having a bore centrally formed therein, the nozzle being in fluid communication with and plugging the central opening such that the paint flows into the nozzle and out of it through the bore formed in the nozzle, the nozzle further having the needle valve terminating in the bore of the nozzle and closing the nozzle when deployed forward fully; and (c) an air cap, the air cap having a forward end and a rearward end, the rearward end of the cap being mounted on the forward end of the tubular extension, the air cap having an opening formed therein substantially around the bore of the nozzle, the air cap having at least two passages formed therein, the at least two passages being in fluid communication with the at least two bores of the extension to allow the air under pressure to flow thereinto, at least two ports formed on the air cap such that the at least two ports are each in fluid communication with one passage the at least two ports allowing the air under pressure to exit the air cap to control the fanning of the spray, the air cap further having at least two channels formed therein in fluid communication with the chamber of the extension, the at least two channels channeling the turbine air through the air cap and past the bore of the nozzle, the turbine air atomizing the paint emitting therefrom.

2. The spray gun of claim 1, wherein the air under pressure supplied to the housing at the second fitting is compressed air.

3. The spray gun of claim 1, wherein the air for fanning the paint spray is turbine air.

4. The spray gun of claim 1, wherein a plurality of apertures are formed in the extension in fluid communication with the air passageway of the housing, the apertures increasing the velocity of the air under pressure.

5. The spray gun of claim 1, wherein the atomizing air temperature is greater than the ambient air, thereby increasing the transfer efficiency.

6. The spray gun of claim 1, wherein the gun has a transfer efficiency in the range of 65 to 90%.

7. The spray gun of claim 1, wherein the spray gun is automatic for application with robots.

* * * * *